US011096870B2

(12) United States Patent
Larry

(10) Patent No.: US 11,096,870 B2
(45) Date of Patent: Aug. 24, 2021

(54) PACIFIER WITH MILK DISPENSER

(71) Applicant: Diane Larry, Waldorf, MD (US)

(72) Inventor: Diane Larry, Waldorf, MD (US)

( * ) Notice: Subject to any disclaimer, the term of this patent is extended or adjusted under 35 U.S.C. 154(b) by 130 days.

(21) Appl. No.: 16/139,495

(22) Filed: Sep. 24, 2018

(65) Prior Publication Data

US 2020/0093706 A1 Mar. 26, 2020

(51) Int. Cl.

| | |
|---|---|
| ***A61J 11/00*** | (2006.01) |
| ***A61J 17/00*** | (2006.01) |
| ***A61J 7/00*** | (2006.01) |

(52) U.S. Cl.

CPC ..... *A61J 11/0095* (2013.01); *A61J 7/0053* (2013.01); *A61J 11/0035* (2013.01); *A61J 17/001* (2015.05)

(58) Field of Classification Search

CPC ..... A61J 17/006; A61J 17/001; A61J 11/0095
See application file for complete search history.

(56) References Cited

U.S. PATENT DOCUMENTS

| | | | | | |
|---|---|---|---|---|---|
| 2,889,829 | A * | 6/1959 | Tannenbaum | A61J 7/0053 | 606/236 |
| 5,078,734 | A * | 1/1992 | Noble | A61J 7/0053 | 604/77 |
| 5,123,915 | A * | 6/1992 | Miller | A61J 7/0007 | 604/77 |
| 5,176,705 | A * | 1/1993 | Noble | A61J 17/006 | 215/11.1 |
| 5,354,274 | A * | 10/1994 | Demeter | A61J 7/0046 | 604/77 |
| 5,620,462 | A * | 4/1997 | Valenti | A61J 17/006 | 215/11.1 |
| D380,270 | S * | 6/1997 | Rekar | D24/194 | |
| 5,662,684 | A * | 9/1997 | Caso | A61J 17/006 | 215/11.6 |
| 5,772,685 | A * | 6/1998 | Crowe | A61J 7/0046 | 604/73 |
| 2006/0155331 | A1* | 7/2006 | Bohmer | A61J 7/0053 | 606/234 |
| 2007/0027479 | A1* | 2/2007 | Carter | A61J 7/0053 | 606/234 |
| 2010/0111772 | A1* | 5/2010 | Hartofelis | B65D 41/20 | 422/400 |
| 2015/0069009 | A1* | 3/2015 | Sheikh | A61J 9/001 | 215/365 |

* cited by examiner

*Primary Examiner* — James N Smalley
*Assistant Examiner* — Jennifer Castriotta
(74) *Attorney, Agent, or Firm* — The Iwashko Law Firm, PLLC; Lev Ivan Gabriel Iwashko

(57) ABSTRACT

A pacifier for dispensing a liquid such as milk, the pacifier including a nipple, including a milk entering aperture disposed at a first end of the nipple, a milk expelling aperture disposed at a second end of the nipple opposite from the first end of the nipple, and a milk holding portion to hold milk therein and to receive the nipple, the milk receiving portion including a milk supplying aperture to correspond to the milk entering aperture of the nipple to supply milk from the milk holding portion to the nipple.

3 Claims, 2 Drawing Sheets

PACIFIER WITH MILK DISPENSER

BACKGROUND

1. Field

The present general inventive concept relates generally to a pacifier, and specifically, to an improved pacifier with a milk dispenser.

2. Description of the Related Art

Many parents use pacifiers as a means to soothe and comfort infants as they mature. A typical pacifier includes a nipple with a mouth guard to prevent the accidental swallowing or choking on the pacifier during use. The pacifier typically is used to soothe the child during discomfort and calm the child for a period of time when necessary. However on occasion a child may cry because they desire to be fed milk. If the child is given a pacifier therefore the child will not receive the milk they desire.

Therefore, it would be advantageous to have a pacifier that could at least provide a small amount of milk to have a more genuine pacifying effect for the infant.

SUMMARY

The present general inventive concept provides a milk-dispensing pacifier that is shaped as a normal pacifier however includes a reservoir for liquid such as milk for dispensing through the nipple. The present general inventive concept also provides a nipple with a release mechanism to release milk from within the mouth guard of the nipple.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing A pacifier for dispensing a liquid such as milk, the pacifier including a nipple, including a milk entering aperture disposed at a first end of the nipple, a milk expelling aperture disposed at a second end of the nipple opposite from the first end of the nipple, and a milk holding portion to hold milk therein and to receive the nipple, the milk receiving portion including a milk supplying aperture to correspond to the milk entering aperture of the nipple to supply milk from the milk holding portion to the nipple.

The nipple may further include a threaded portion, and the milk holding portion may further include a nipple receiving threaded portion to receive the threaded portion of the nipple, such that the nipple is screwed onto the milk holding portion.

The milk holding portion may further include a seal disposed at the milk supplying aperture to prevent the milk from exiting the milk supplying aperture, and the nipple may further include a seal breaking portion to break the seal such that the milk is supplied from the milk holding portion to the nipple.

The seal may be broken to allow the milk to flow when the nipple is twisted in a first direction, and the seal may be re-sealed to stop the milk from flowing when the nipple is twisted in a second direction

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
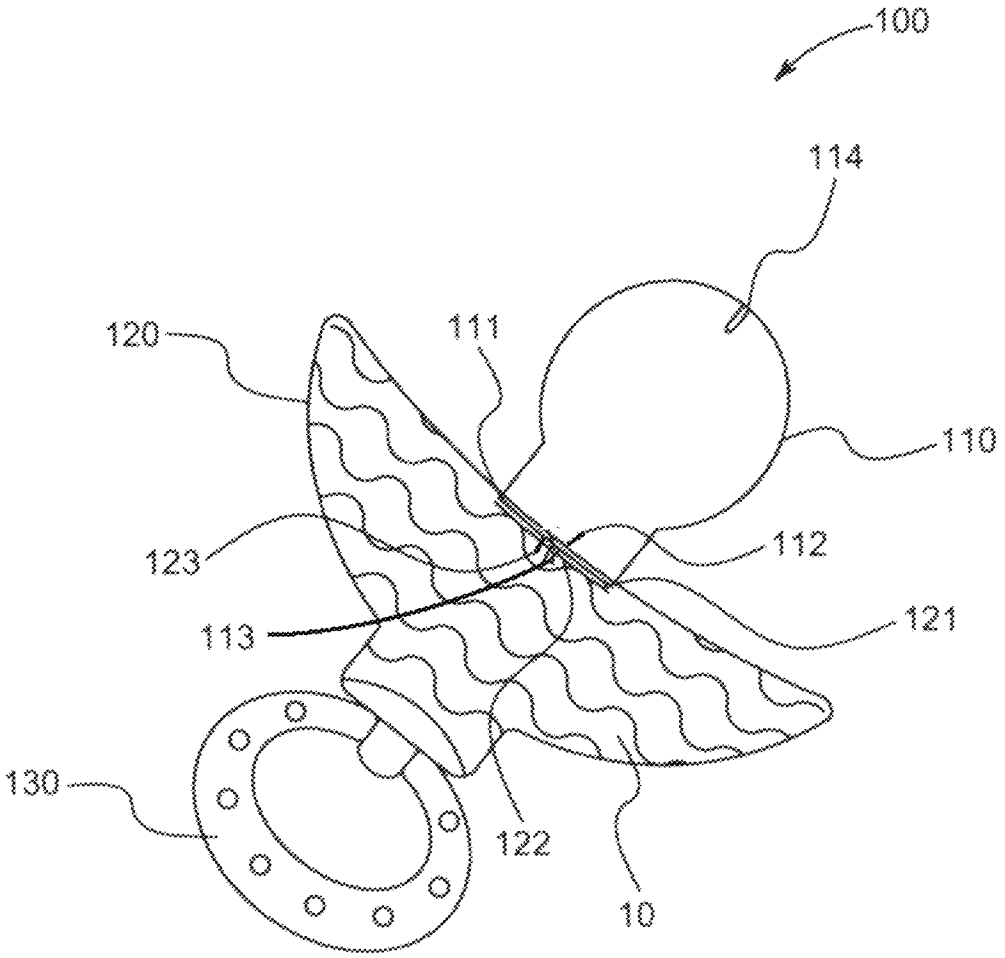
FIG. 1 illustrates a side perspective view of a pacifier, according to an exemplary embodiment of the present general inventive concept.

FIG. 1 illustrates a side perspective view of a pacifier 100, according to an exemplary embodiment of the present general inventive concept.

With respect to FIG. 1, the pacifier 100 may include a nipple 110 and a milk holding portion 120, but is not limited thereto.

The nipple 110 may include a threaded portion 111, a milk entering aperture 112, a seal breaking member 113, and a milk expelling aperture 114, but is not limited thereto.

The nipple 110 may be shaped like a pacifier nipple known to one of ordinary skill in the art.

The milk entering aperture 112 may be disposed at a first end of the nipple 110, while the milk expelling aperture 114 may be disposed at a second end of the nipple 110 opposite from the first end of the nipple 110.

The milk holding portion 120 may include a nipple receiving threaded portion 121, a milk supplying aperture 122, a seal 123, and a ring 130, but is not limited thereto.

The milk holding portion 120 may have a substantially similar shape of a mouth guard of a pacifier known to one of ordinary skill in the art.

The nipple 110 may be removably attachable to the milk holding portion 120. Specifically, to attach the nipple 110 to the milk holding portion 120, the threaded portion 111 may be screwed into the nipple receiving threaded portion 121.

In order to fill the milk holding portion 120 with milk 10, the nipple 110 may be unscrewed from the milk holding portion 120. Specifically, the threaded portion 111 may be unscrewed from the nipple receiving threaded portion 121. Subsequently, once the nipple 110 is detached from the milk holding portion 120, the milk 10 may be poured into the milk supplying aperture 122 of the milk holding portion 120.

After the milk holding portion 120 is filled with the milk 10, the nipple 110 may be screwed onto the milk holding portion 120. Specifically, the threaded portion 111 may be screwed into the nipple receiving threaded portion 121, such that the milk supplying aperture 122 of the milk holding portion 120 is in line with the milk entering aperture 112 of the nipple 110. In other words, the milk holding portion 120 includes the nipple receiving threaded portion 121 to receive the threaded portion 111 of the nipple 110, such that the nipple 110 may be screwed onto and connected to the milk holding portion 120.

The seal 123, which may be optionally provided in the present general inventive concept to be disposed at the milk supplying aperture 122 of the milk holding member 120, may be deformable and/or removable to allow the milk 10 to enter and remain within the milk holding portion 120. As such, optionally, the seal breaking member 113 may be provided at the milk entering aperture 112 of the nipple 110 to allow the seal 123 to be broken in order to allow the milk 10 to flow from the milk holding portion 120 to the nipple 110.

The seal 123 may be broken (temporarily) by a twisting of the nipple 110 in a first direction, in order to allow the milk 10 to flow from the milk holding portion 120 to the nipple 110. A twisting of the nipple 110 in a second direction may cause the milk 10 to cease flowing, thereby turning the pacifier 100 into a regular pacifier without the milk-flowing functionality (i.e., to be used just for infants who are teething).

When an infant places the nipple 110 into a mouth of the infant and begins to suck, the milk 10 may pass from the milk supplying aperture 122 of the milk holding portion 120 through to the milk entering aperture 112 of the nipple 110, such that an inner portion of the nipple 10 is at least partially filled with the milk 10 to allow the milk 10 to be sucked through the milk expelling aperture 114 and into the mouth of the infant.

The infant, or parent of the infant, may hold the pacifier by the ring 130, which may be disposed at a base of the milk holding portion 120 opposite from the nipple 110.

Figure 2:
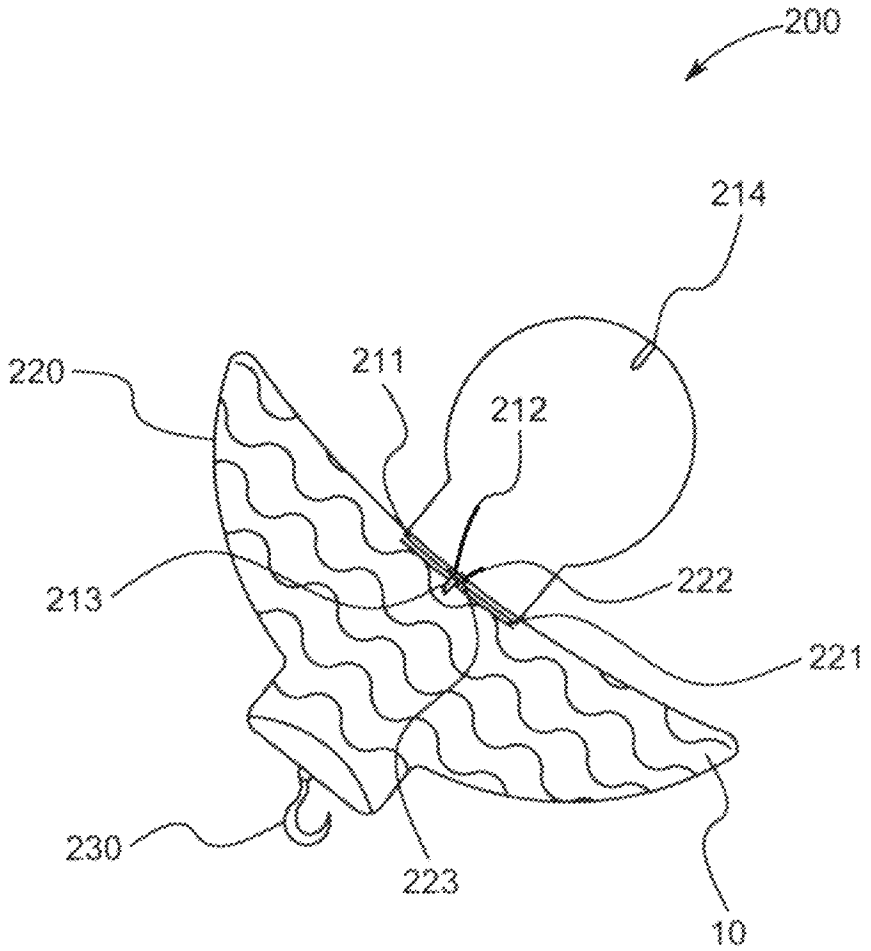
FIG. 2 illustrates a side perspective view of a pacifier, according to another exemplary embodiment of the present general inventive concept.

FIG. 2 illustrates a side perspective view of a pacifier 200, according to another exemplary embodiment of the present general inventive concept.

With respect to FIG. 2, the pacifier 200 may include a nipple 210 and a milk holding portion 220, but is not limited thereto.

The nipple 210 may include a threaded portion 211, a milk entering aperture 212, a seal breaking member 213, and a milk expelling aperture 214, but is not limited thereto.

The nipple 210 may be shaped like a pacifier nipple known to one of ordinary skill in the art.

The milk entering aperture 212 may be disposed at a first end of the nipple 210 on the seal breaking member 213, while the milk expelling aperture 214 may be disposed at a second end of the nipple 210 opposite from the first end of the nipple 210.

The milk holding portion 220 may include a nipple receiving threaded portion 221, a milk supplying aperture 222, a seal 223, and a hook 230, but is not limited thereto.

The milk holding portion 220 may have a substantially similar shape of a mouth guard of a pacifier known to one of ordinary skill in the art.

The nipple 210 may be removably attachable to the milk holding portion 220. Specifically, to attach the nipple 210 to the milk holding portion 220, the threaded portion 211 may be screwed into the nipple receiving threaded portion 221.

In order to fill the milk holding portion 220 with milk 10, the nipple 210 may be unscrewed from the milk holding portion 220. Specifically, the threaded portion 211 may be unscrewed from the nipple receiving threaded portion 221. Subsequently, once the nipple 210 is detached from the milk holding portion 220, the milk 10 may be poured into the milk supplying aperture 222 of the milk holding portion 220.

After the milk holding portion 220 is filled with the milk 10, the nipple 210 may be screwed onto the milk holding portion 220. Specifically, the threaded portion 211 may be screwed into the nipple receiving threaded portion 221, such that the milk supplying aperture 222 of the milk holding portion 220 is in line with the milk entering aperture 212 of the nipple 210. In other words, the milk holding portion 220 includes the nipple receiving threaded portion 221 to receive the threaded portion 121 of the nipple 210, such that the nipple 210 may be screwed onto and connected to the milk holding portion 220.

The seal 223, which may be optionally provided in the present general inventive concept to be disposed at the milk supplying aperture 222 of the milk holding member 220, may be deformable and/or removable to allow the milk 10 to enter and remain within the milk holding portion 220. As such, optionally, the seal breaking member 213 may release the milk 10 through the milk entering aperture 212 in response to pushing through the seal 223, such that the seal 223 is temporarily deformed (i.e. broken) in order to allow the milk 10 to flow from the milk holding portion 220 to the nipple 210.

When an infant places the nipple 210 into a mouth of the infant and begins to suck, the milk 10 may pass from the milk supplying aperture 222 of the milk holding portion 220 through to the milk entering aperture 212 of the nipple 210, such that an inner portion of the nipple 10 is at least partially filled with the milk 10 to allow the milk 10 to be sucked through the milk expelling aperture 214 and into the mouth of the infant.

The infant, or parent of the infant, may use the hook 230 to attach the pacifier 200 to another device. The hook 230 may be disposed at a base of the milk holding portion 220 opposite from the nipple 210.

Although the milk 10 has been utilized above as a liquid, and the components are described as holding milk, and liquid may be used in the present general inventive concept, and therefore, is not limited to milk.

All of the apertures described above may have differing sizes and shapes, in order to maximize efficiency from supplying the milk 10 from the milk holding portion 120 (220) to the nipple 110 (210), and to provide a comfortable milk stream as it is sucked through the milk expelling aperture 114 (214).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A pacifier for dispensing a liquid such as milk, the pacifier comprising:

a nipple, comprising:

a milk entering aperture disposed at a first end of the nipple, a milk expelling aperture disposed at a second end of the nipple opposite from the first end of the nipple, and a seal breaking member disposed at the milk entering aperture; and a milk holding portion to hold milk therein and to receive the first end of the nipple, the milk holding portion comprising:

a milk supplying aperture to correspond to the milk entering aperture of the nipple to supply milk from the milk holding portion to the nipple, such that a diameter at the second end of the nipple is greater than a size of the milk entering aperture and the milk supplying aperture, and a seal disposed at the milk supplying aperture to prevent the milk from exiting the milk supplying aperture, such that the seal breaking member breaks the seal and the milk is supplied from the milk holding portion to the nipple.

2. The pacifier of claim 1, wherein:

the nipple further comprises a threaded portion; and the milk holding portion further comprises a nipple receiving threaded portion to receive the threaded portion of the nipple, such that the nipple is screwed onto the milk holding portion.

3. The pacifier of claim 1, wherein the seal is broken to allow the milk to flow when the nipple is twisted in a first direction, and the seal is re-sealed to stop the milk from flowing when the nipple is twisted in a second direction.

* * * * *